US006440093B1

(12) United States Patent
McEwen et al.

(10) Patent No.: US 6,440,093 B1
(45) **Date of Patent: *Aug. 27, 2002**

(54) APPARATUS AND METHOD FOR MONITORING PNEUMATIC LIMB COMPRESSION THERAPY

(76) Inventors: James Allen McEwen, 10551 Bamberton Drive, Richmond, B.C. (CA), V7A 1K6; Michael Jameson, 2365 Badger Road, North Vancouver, B.C. (CA), V7G 1S9; Jonathan J. Nakane, 643 East 59th Avenue, Vancouver, B.C. (CA), V5X 1Y2

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/105,804

(22) Filed: Jun. 26, 1998

Related U.S. Application Data

(63) Continuation-in-part of application No. 08/639,782, filed on Apr. 29, 1996, now Pat. No. 5,843,007.

(51) Int. Cl.[7] ..... A61H 9/00

(52) U.S. Cl. ..... 601/150; 601/9; 601/148

(58) Field of Search ..... 601/9, 11, 148, 601/149, 150, 151, 152, 43, 44, 6; 600/492, 495

(56) References Cited

U.S. PATENT DOCUMENTS 3,892,229 A 7/1975 Taylor et al.
3,942,518 A * 3/1976 Tenteris et al. ..... 601/150
4,013,069 A 3/1977 Hasty
4,331,133 A 5/1982 Arkans
4,375,217 A 3/1983 Arkans
4,396,010 A 8/1983 Arkans
4,408,599 A 10/1983 Mummert (List continued on next page.)

FOREIGN PATENT DOCUMENTS

WO WO93/12708 7/1993
WO WO95/18594 7/1995
WO WO95/22307 8/1995
WO WO95/26705 10/1995

OTHER PUBLICATIONS

McEwen JA, Masri BA, Nakane JJ, Duncan CP. Variations In Delivered Pneumatic Compression Therapy For OVT Prophylaxis May Significantly Affect Reported Patient Outcomes. Proc. 24 Can Med Biol Eng Conf 1 9984, 2 pages (Abstract).

Comerota AJ, Katz, ML, White, JV, White Why Does Prophylaxis With External Pneumatic Compression for Deep Vein Thrombosis Fail? *Amer. Journ. of Surg.* V 164 pp 265–268 9/1992.

(List continued on next page.)

*Primary Examiner*—Justine R. Yu
(74) *Attorney, Agent, or Firm*—Ipsolon LLP

(57) ABSTRACT

Apparatus for monitoring the application of a varying pressure to a limb from a sleeve positioned on the limb in order to augment the flow of venous blood and thus reduce the incidence of embolism and deep venous thrombosis in the limb. The apparatus includes a transducer for producing a sleeve pressure signal that is indicative of pressure applied by the sleeve to the limb. This signal is used for periodically measuring the value of a preselected pressure waveform parameter (such as maximum pressure produced in the sleeve). The microprocessor-controlled apparatus also generates an interval signal that is indicative of a time interval during which the value of the selected waveform parameter remains within a particular range.

14 Claims, 7 Drawing Sheets

U.S. PATENT DOCUMENTS

| | | | | | |
|---|---|---|---|---|---|
| 4,419,988 | A | | 12/1983 | Mummert | |
| 4,469,099 | A | | 9/1984 | McEwen | |
| 4,718,427 | A | * | 1/1988 | Russell | 600/482 |
| 4,841,956 | A | | 6/1989 | Gardner | |
| 4,867,140 | A | * | 9/1989 | Hovis et al. | 601/152 |
| 4,883,462 | A | * | 11/1989 | Williamson et al. | 601/152 |
| 5,007,411 | A | | 4/1991 | Dye | |
| 5,022,387 | A | | 6/1991 | Hasty | |
| 5,031,604 | A | | 7/1991 | Dye | |
| 5,048,533 | A | * | 9/1991 | Muz | 600/492 |
| 5,254,087 | A | | 10/1993 | McEwen | |
| 5,307,791 | A | * | 5/1994 | Senoue et al. | 601/9 |
| 5,437,610 | A | * | 8/1995 | Cariapa et al. | 601/152 |
| 5,439,477 | A | | 8/1995 | McEwen | |
| 5,443,440 | A | | 8/1995 | Tumey | |
| 5,575,762 | A | * | 11/1996 | Peeler et al. | 601/152 |
| 5,607,447 | A | | 3/1997 | McEwen | |
| 5,669,872 | A | * | 9/1997 | Fox | 601/152 |
| 5,815,864 | A | * | 10/1998 | Sloop | 5/706 |
| 5,833,619 | A | * | 11/1998 | Freed et al. | 600/485 |
| 5,876,359 | A | * | 3/1999 | Bock et al. | 601/152 |

OTHER PUBLICATIONS

Westrich GH, Sculco TP. Prophylaxis Against Deep Vein Thrombosis After Total Knee Arthroplasty. J Bone Joint Surg [Am] 1996; 78–A: 826–8 34.

Jacobs DG, Piotrowski JJ, Hoppensteadt DA, Salvator AE, Fareed J. Hemdynamic And Fibrinolytic Consequences Of Intermittent Pneumatic Compression: Preliminary Results. J Trauma 1996; 40:710–716.

Olson DA, Kamm RD, Shapiro AH. Bioengineering Studies Of Periodic External Compression As Prophylaxis Against Deep Vein Thrombosis—Part II: Experimental Studies On A Simulated Leg. Transactions of the ASME 1982; 104: 96.

Kamm R, Butcher R, Froelich J, Johnson M, Salzman E, Shapiro A, Strauss HW. Optimisation of Indices of External Pneumatic Compression for Prophylaxis Against Deep Vein Thrombosis: Radionuclide Gated Imaging Studies. Cardiovasc Res 1986: 20: 588–596.

Nicolaides AN, Fernandes e Fernandes J, Pollock AV. Intermittent Sequential Pneumatic Compression of the Legs in the Prevention of Venous Stasis and Postoperative Deep Venous Thrombosis. Surgery 1980; 87: 69–75.

Jobst Athrombic Pump System 2500; Jobst Medical Canada, Inc.; 4–page product brochure; Jan. 1994.

Comerota, AJ et al; The Fibrinolytic Effects of Intermittent Pneumatic Compression, Annals of Surgery, V 226. No. 3; pp. 306–314 circa Jan. 1997.

* cited by examiner

APPARATUS AND METHOD FOR MONITORING PNEUMATIC LIMB COMPRESSION THERAPY

This is a continuation-in-part of U.S. patent application Ser. No. 08/639,782 filed Apr. 29, 1996, now U.S. Pat. No. 5,843,007 which is hereby incorporated by reference.

FIELD OF THE INVENTION

The invention is related to apparatus and methods for monitoring pneumatic limb compression therapy given to the limbs of human subjects in order to help prevent deep vein thrombosis, pulmonary embolism and death.

BACKGROUND OF THE INVENTION

Limb compression systems of the prior art apply and release pressure on a patient's extremity to augment venous blood flow and help prevent deep vein thrombosis (DVT), pulmonary embolism (PE) and death. Limb compression systems of the prior art typically include: a source of pressurized gas; one or more pneumatic sleeves for attaching to one or both of the lower limbs of a patient; and an instrument connected to the source of pressurized gas and connected to the sleeves by means of pneumatic tubing, for controlling the inflation and deflation of the sleeves and their periods of inflation and deflation. In U.S. Pat. No. 3,892,229 Taylor et al. describe an early example of one general type of limb compression system of the prior art known as an intermittent limb compression system; such systems apply pressure intermittently to each limb by inflating and deflating a single-bladder sleeve attached to the limb. In U.S. Pat. No. 4,013,069 Hasty describes an example of a second general type of limb compression system of the prior art, known as a sequential limb compression system; such systems apply pressure sequentially along the length of the limb by means of a multiple-bladder sleeve or multiple sleeves attached to the same limb which are inflated and deflated at different times. Certain intermittent and sequential limb compression systems of the prior art are designed to inflate and deflate sleeves thereby producing pressure waveforms to be applied to both limbs either simultaneously or alternately, while others are designed to produce pressure waveforms for application to one limb only.

One major concern with all pneumatic limb compression systems of the prior art is that the therapy actually delivered by these systems may vary substantially from the expected compression therapy. For example, a recent clinical study designed by one of the inventors of the present invention, and involving the most commonly used sequential pneumatic limb compression systems of the prior art, showed that the pneumatic limb compression therapy actually delivered to 49 patients following elective total hip replacement surgery varied widely from therapy expected by the operating surgeons in respect of key parameters of the therapy shown in the clinical literature to affect patient outcomes related to the incidence of deep venous thrombosis, pulmonary embolism and death. These key parameters included the rates of pressure rise delivered by each of the inflatable bladders of the sleeves and the maximum pressures delivered by each of the inflatable bladders. The study methodology involved continuous monitoring of the pressure of the compressed air in the pneumatic sleeves of these systems, permitting the pneumatic compression therapy actually delivered to patients to be directly monitored throughout the prescribed period of therapy and compared to the expectations of operating surgeons. The results of this clinical study indicated that the expected therapy was not delivered to any of the 49 patients monitored: therapy was only delivered an average of 77.8 percent of the time during the expected periods of therapy; the longest interruptions of therapy in individual subjects averaged 9.3 hr; and during 99.9 percent of the expected therapy times for all 49 patients monitored in the study, values of key outcomes-related parameters of the therapy actually delivered to the patients varied by more than 10 percent from expected values. The unanticipated range of variations that was found in this clinical study between expected and delivered pneumatic compression therapy, within individual patients and across all patients, may be an important source of variations in patient outcomes in respect of the incidence of deep vein thrombosis, pulmonary embolism and death, and may be an important confounding variable in comparatively evaluating reports of those patient outcomes. The present invention addresses many of the limitations of prior-art systems that have led to such unanticipated and wide variations between the expected therapy and the therapy actually delivered to patients.

Limb compression systems currently available do not have the capability of accurately producing a desired pressure waveform in combination with sleeves having differing designs and varying pneumatic volumes, or when sleeve application techniques vary and the resulting sleeve snugness varies, or when sleeves are applied to limbs of differing sizes, shapes and tissue characteristics. Such variables produce substantial variations between the expected and actual pressure waveforms delivered by limb compression systems. Clinical staff using such prior-art systems have very inaccurate and limited knowledge of what pressure waveforms have actually being applied to the patient relative to what was prescribed. Clinical staff using such systems also have no knowledge of the time intervals between occurrences when the expected therapy matches the therapy actually delivered. These are significant limitations with systems of the prior art, as evidence in the clinical literature suggests that applied pressure waveforms having different shapes and waveform parameters produce substantially different changes to venous blood flow and that both the duration of compression therapy and interruptions in compression therapy have an effect on the incidence of DVT, embolism and death.

Some limb compression systems of the prior art attempt to record and display the total cumulative time during which pneumatic compression therapy was delivered to a patients limb, but do not differentiate between times when the delivered therapy was near the expected therapy and when it was not. For example, commercially available systems such as the Plexipulse intermittent pneumatic compression device (NuTech, San Antonio Tex.) and Aircast intermittent pneumatic compression device (Aircast Inc., Summit, N.J.) record the cumulative time that compressed air was delivered to each compression sleeve. These are typical of prior-art systems which include simple timers that record merely the cumulative time that the systems were in operation.

In U.S. Pat. No. 5,443,440 Tumey et al. describe a pneumatic limb compression system capable of recording compliance data by creating and storing the time, date and duration of each use of the system for subsequent transmission to a physician's computer. The compliance information recorded by this system contains only information relating to when the system was used on a patient and the cumulative duration of usage. Tumey et al. cannot and does not record or monitor times when pressure-related values of the delivered therapy matched the expected therapy and when they did not.

A major limitation of Tumey et al. and other limb compression systems of the prior art is that key parameters of pneumatic compression therapy that are known to affect patient outcomes are not monitored and recorded. This is a serious limitation because evidence in the clinical literature shows that variations in applied pressure waveforms produce substantial variations in venous blood flow, and that delays and interruptions in the delivery of pneumatic compression therapy affect the incidence of DVT. One key parameter identified by the inventors of the present invention is the interval between successive occurrences of delivered pressure waveforms having expected values of certain waveform parameters known to affect patient outcomes. Because this key parameter is not monitored as therapy is delivered by prior-art systems, variations between delivered and expected therapy cannot be detected as they occur, and clinical staff and patients cannot be alerted to take corrective measures for improving therapy and patient outcomes.

Because prior-art systems do not monitor the interval between successive occurrences of delivered pressure waveforms having expected values of certain waveform parameters known to affect patient outcomes, and because such prior-art systems do not therefore have alarms to alert clinicians and patents that a maximum time interval has elapsed during which the expected therapy was not delivered to the patient, then the operator and the patient cannot adapt such systems during therapy, including for example sleeve re-application, sleeve repositioning or changing certain operating parameters of the instrument supplying pressurized gas to the sleeve, to help assure that the prescribed and expected therapy is actually delivered to the patient throughout as much as possible of the prescribed duration of therapy.

Additionally, limb compression systems do not subsequently produce the recorded values of key outcomes-related parameters for use by physicians and others in determining the extent to which the prescribed and expected pressure waveforms were actually applied to the patient for use by third-party payors in reimbursing for therapy actually provided, and for use in improving patient outcomes by reducing variations in parameters known to produce variations in patient outcomes.

SUMMARY OF THE INVENTION

The present invention provides apparatus and method for monitoring the application of a varying pressure to a patients limb from a sleeve positioned on the limb in order to help augment the flow of venous blood in the limb and thereby reduce the incidence of deep vein thrombosis, pulmonary embolism and death. More specifically, the present invention includes: transducing means for producing a sleeve pressure signal indicative of pressure applied by the sleeve to the limb; waveform parameter measurement means responsive to the sleeve pressure signal for measuring the value of a predetermined pressure waveform parameter and for producing a waveform parameter signal indicative of the measured value of the waveform parameter; and interval determination means responsive to the waveform parameter signal for producing an interval signal indicative of an interval between a first occurrence when the measured value of the waveform parameter is near a predetermined parameter level and the next occurrence when the measured value of the waveform parameter is near the predetermined parameter level.

The present invention includes means to allow an operator to select the predetermined pressure waveform parameter and the predetermined parameter level from a plurality of predefined parameters and parameter levels. In the present invention, the pressure waveform parameter can be a predetermined variation in the estimated level of pressure of gas in the sleeve that augments the flow of venous blood into the limb proximal to the sleeve from the limb beneath the sleeve.

The interval determination means of the present invention can include means for measuring a number of intervals during therapy, each corresponding to the time between an occurrence when the measured value of the waveform parameter is near the predetermined parameter level and the next occurrence when the measured value of the waveform parameter is near the predetermined parameter level. The interval determination means can further include a clock for determining the clock times when occurrences are measured.

Alarm means are included in the present invention for producing an indication perceptible to the operator and the patient when a measured interval exceeds a predetermined maximum interval, thereby allowing the operator or the patient or the operator to take corrective action in an effort to reduce future measured intervals to values below the predetermined maximum interval.

In the present invention, if the sleeve is pneumatic and applies pressure to the limb when inflated with pressurized gas from a pressurizing means, the pressure transducing means may be connectable to the sleeve through tubing means so that it communicates pneumatically with the sleeve and only communicates pneumatically with the pressurizing means through the sleeve.

DETAILED DESCRIPTION OF THE PREFERRED EMBODIMENT

The embodiment illustrated is not intended to be exhaustive or limit the invention to the precise form disclosed. It is chosen and described in order to explain the principles of the invention and its application and practical use, and thereby enable others skilled in the art to utilize the invention.

In the context of the preferred embodiment, a pressure waveform is generally considered to be a curve that represents the desired or actual amplitude of pressure in a pneumatic sleeve applied to a patient over time, and is described by a graph in rectangular coordinates whose abscissas represent times and whose ordinates represent the values of the pressure amplitude at the corresponding times.

In the context of the preferred embodiment a pressure waveform parameter is a characteristic of an applied pressure waveform used to augment the flow of venous blood. For example waveform parameters may include: (a) the maximum pressure applied during a predetermined time period; (b) the rate of rise of pressure during a predetermined time period; (c) pressure thresholds which must be exceeded for predetermined time periods.

The preferred embodiment of the invention is described in two sections below: instrumentation and software.

I. Instrumentation

Figure 1A:
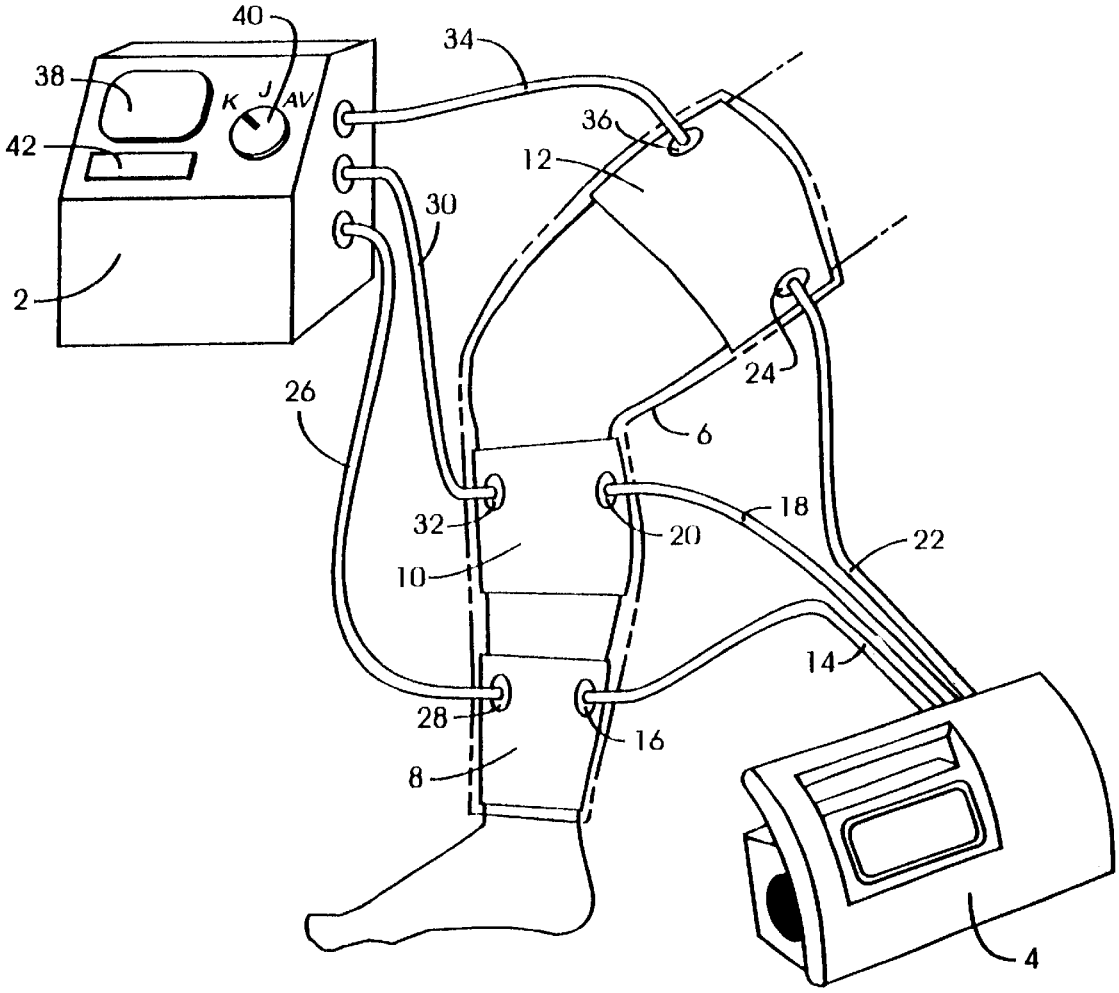
FIGS. 1*a*, 1*b*, and 1*c* each show a pictorial representation of a preferred embodiment in a typical clinical application.

FIG. 1*a* depicts limb compression therapy monitor 2 configured to monitor the compression therapy delivered by sequential pneumatic compression device 4 connected to leg sleeve 6. Leg sleeve 6 is composed of three inflatable chambers for applying pressures to regions of a patients limb, lower calf chamber 8, upper calf chamber 10, and thigh chamber 12. Sequential pneumatic compression device 4 has three pneumatically separate output channels which connect to each of the inflatable chambers of leg sleeve 6: the first output channel connects to lower calf chamber 8 via pneumatic tubing 14 and pneumatic connector 16, the second output channel connects to upper calf chamber 10 via pneumatic tubing 18 and pneumatic connector 20, and the third output channel connects to thigh chamber 12 via pneumatic tubing 22 and pneumatic connector 24. When delivering compression therapy sequential pneumatic compression device 4 repetitively produces pressure waveforms in each of the three inflatable chambers of leg sleeve 6, lower calf chamber 8, upper calf chamber 10, and thigh chamber 12, in order to augment the flow of venous blood from a patients limb.

In the preferred embodiment, limb compression therapy monitor 2 has three independent input channels, channel "A", channel "B", and channel "C", and is adapted to monitor the pressures in up to three inflatable chambers of a limb compression sleeve. When monitoring the therapy delivered by sequential pneumatic compression device 4, as shown in FIG. 1*a*, limb compression therapy monitor 2 pneumatically connects to lower calf chamber 8 of leg sleeve 6 via pneumatic tubing 26 and pneumatic connector 28, pneumatically connects to upper calf chamber 10 of leg sleeve 6 via pneumatic tubing 30 and pneumatic connector 32, and pneumatically connects to thigh chamber 12 of leg sleeve 6 via pneumatic tubing 34 and pneumatic connector 36. As depicted in FIGS. 1*a*, 1*b*, 1*c* and 2, limb compression therapy monitor 2 has a liquid crystal graphic display 38, which is used to display information to the operator of limb compression therapy monitor 2. Display 38 is employed for the selective presentation of any of the following information as described below: (a) menus of commands for controlling limb compression therapy monitor 2, from which an operator may make selections; (b) values of pressure waveform parameters measured in inflatable chambers connected to limb compression therapy monitor 2; (c) reference values of pressure waveform parameters; (d) text messages describing current alarm conditions, when alarm conditions are determined by limb compression therapy monitor 2; (e) graphical and text representations of the time intervals between the production of pressure waveforms having desired predetermined parameters in inflatable sleeves connected to limb compression therapy monitor 2; and (f) messages which provide operating information to the operator.

Therapy selector 40 shown in FIGS. 1*a*, 1*b*, 1*c* and 2 allows the operator to configure limb compression therapy monitor 2 for the type of limb compression therapy that is to be monitored. Signals from therapy selector 40 are used in determining the pressure waveform parameters and reference values of these pressure waveform parameters to use while monitoring compression therapy, as described below. Control panel 42 shown in FIGS. 1*a*, 1*b*, 1*c* and 2 provides a means for the operator to control the operation of limb compression therapy monitor 2. An operator may by manipulating control panel 42 (a) adjust reference values of alarm limits; (b) adjust reference values of pressure waveform parameters; and (c) initiate the display of a history of interval times between the application of pressure waveforms.

Figure 1B:
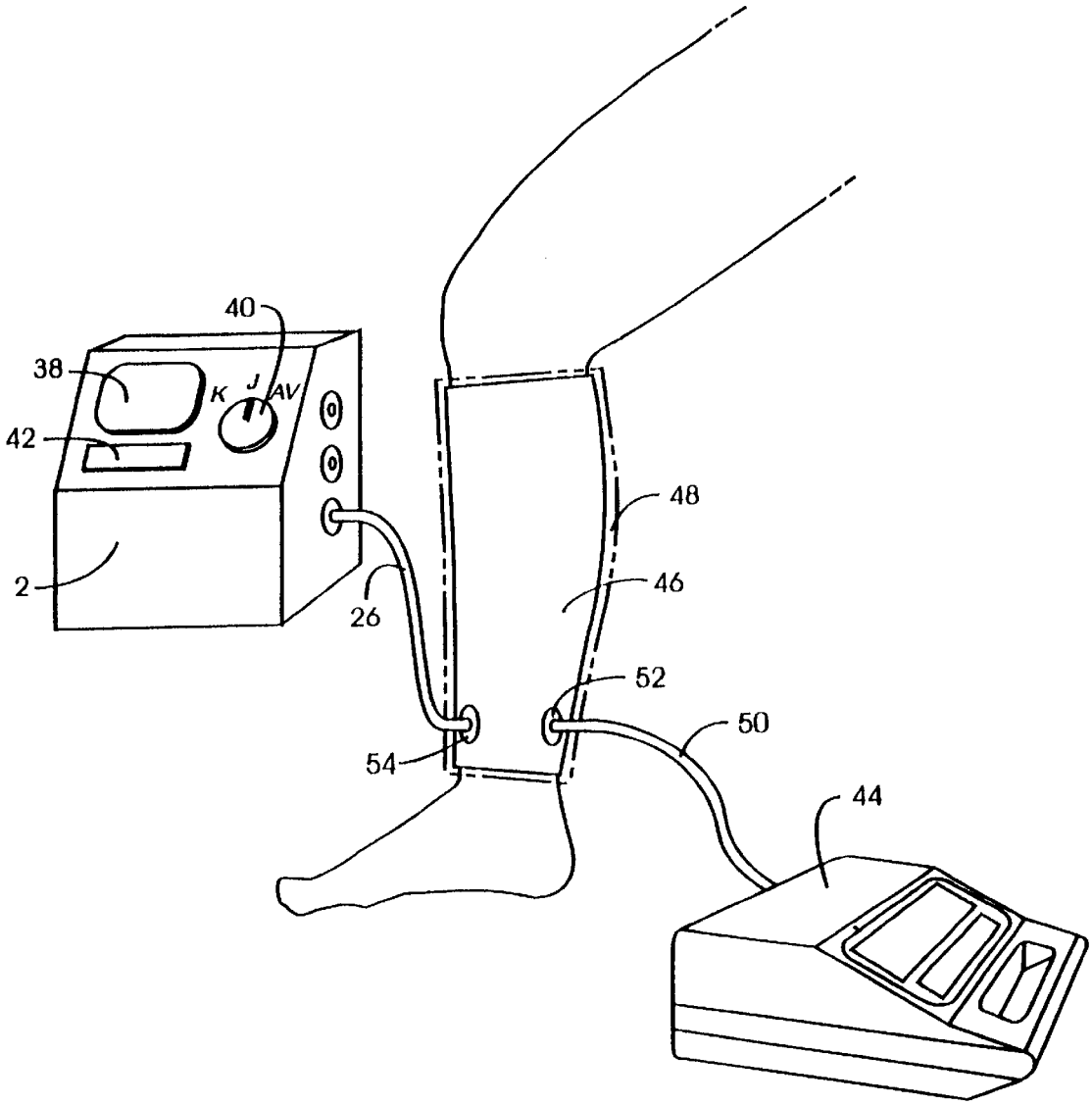
Figure 1C:
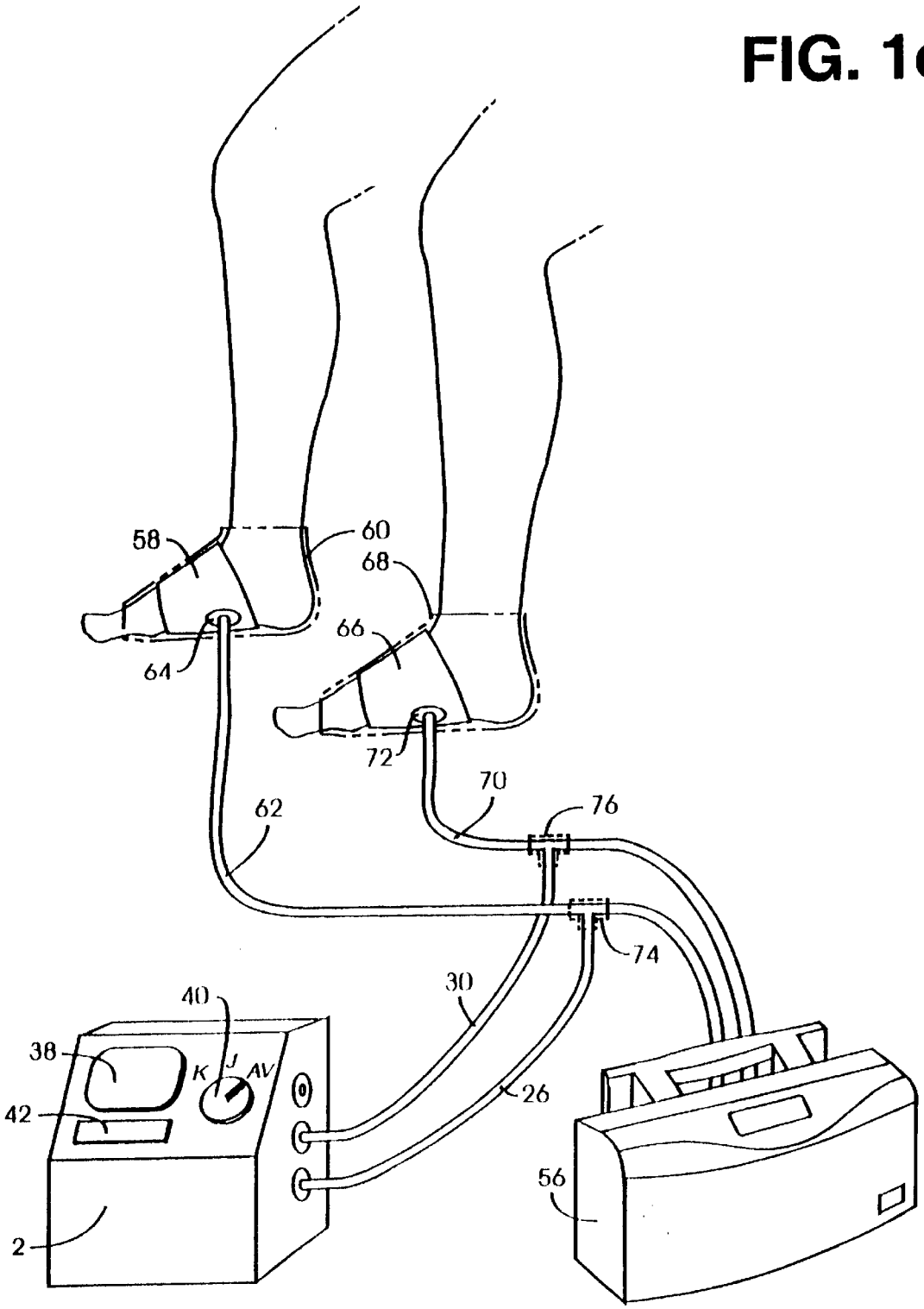

As shown in FIGS. 1*b* and 1*c*, limb compression therapy monitor 2 may be configured to monitor the compression therapy delivered by other pneumatic limb compression systems applied to other regions of the lower or upper limbs. FIG. 1*b* depicts limb compression therapy monitor 2 configured to monitor compression therapy delivered by intermittent pneumatic compression system 44. Intermittent pneumatic compression system 44 is pneumatically connected to inflatable chamber 46 of calf sleeve 48 via pneumatic tubing 50 and pneumatic connector 52. Limb compression therapy monitor 2 pneumatically connects to calf chamber 46 of calf sleeve 48 via pneumatic tubing 26 and pneumatic connector 54.

FIG. 1*c* depicts limb compression therapy monitor 2 configured to monitor compression therapy delivered to the plantar regions of a patient's feet by intermittent pneumatic compression system 56. Intermittent pneumatic compression system 56 is pneumatically connected to inflatable chamber 58 of left foot sleeve 60 via pneumatic tubing 62 and pneumatic connector 64, and is pneumatically connected to inflatable chamber 66 of right foot sleeve 68 via pneumatic tubing 70 and pneumatic connector 72. Limb compression therapy monitor 2 pneumatically connects to inflatable chamber 58 of left foot sleeve 60 via pneumatic tubing 26 and pneumatic T-connector 74, which provides a pneumatic connection with pneumatic tubing 62, and thereby inflatable chamber 58. Limb compression therapy monitor 2 pneumatically connects to inflatable chamber 66 of left foot sleeve 68 via pneumatic tubing 30 and pneumatic T-connector 76, which provides a pneumatic connection with pneumatic tubing 70 and thereby inflatable chamber 66.

Figure 2:
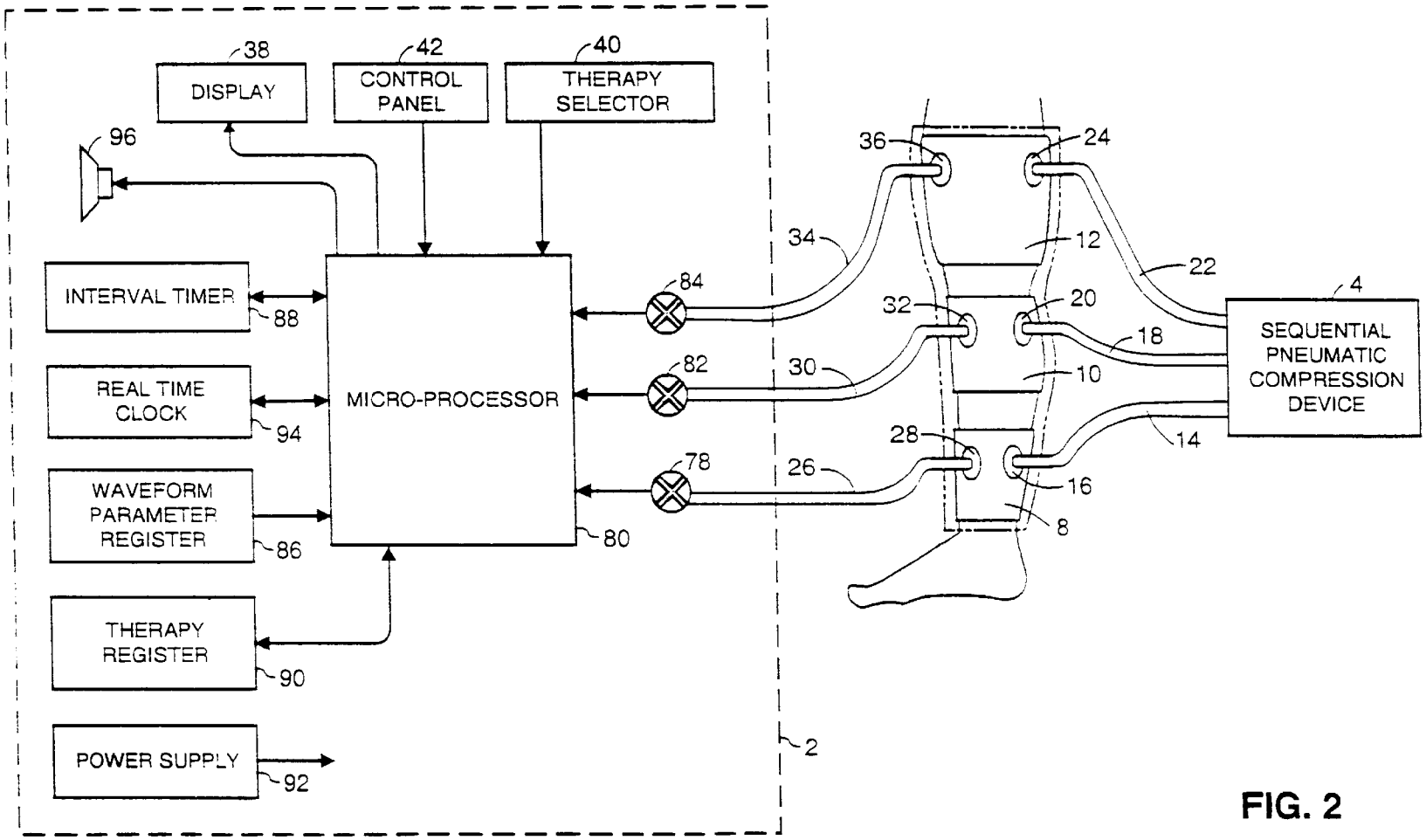
FIG. 2 is a block diagram of the preferred embodiment.

FIG. 2 is a block diagram of limb compression therapy monitor 2 configured to monitor the compression therapy delivered by sequential pneumatic compression device 4. Pressure transducer 78 communicates pneumatically with lower calf chamber 8 by means of pneumatic tubing 26 and pneumatic connector 28, and communicates electrically to an analog to digital converter (ADC) input of microprocessor 80 and generates a channel "A" pressure signal, representative of the pressure of gas in lower calf chamber 8. Pressure transducer 82 communicates pneumatically with upper calf chamber 10 by means of pneumatic tubing 30 and pneumatic connector 32, and communicates electrically to an analog to digital converter (ADC) input of microprocessor 80 and generates a channel "B" pressure signal, representative of the pressure of gas in upper calf chamber 10. Pressure transducer 84 communicates pneumatically with thigh chamber 12 by means of pneumatic tubing 34 and pneumatic connector 36, and communicates electrically to an analog to digital converter (ADC) input of microprocessor 80 and generates a channel "C" pressure signal, representative of the pressure of gas in thigh chamber 12.

Referring again to FIG. 2, to monitor the compression therapy delivered by sequential pneumatic compression device 4, microprocessor 80 responds to a therapy selection signal generated by therapy selector 40 to retrieve reference values of pressure waveform parameters from waveform parameter register 86.

Waveform parameter register 86 stores reference values of predetermined pressure waveform parameters. For each type of compression therapy monitored by limb compression therapy monitor 2, a corresponding set of reference values of predetermined pressure waveform parameters for channels "A", "B", and "C" are stored. For example, pressure waveform parameters and their corresponding reference values for the channel "A" pressure waveform parameters when monitoring compression therapy delivered by sequential pneumatic compression device 4 include: (a) 45 mmHg for maximum pressure applied during the cycle time period; (b)

10 mmHg per second rate of pressure rise maintained for a period of 3 seconds; (c) a pressure threshold of 30 mmHg exceeded for a period of 7 seconds. As described further below, microprocessor 80 uses the reference values of these waveform parameters to verify that pressure waveforms having desired characteristics have been applied to the patient.

To monitor the therapy delivered by sequential compression system 4, microprocessor 80 analyzes the channel "A" pressure signal generated by pressure transducer 78 representative of the pressure in lower calf chamber 8 in order to measure predetermined waveform parameters for which reference values have been retrieved from waveform parameter register 86. Microprocessor 80 then computes the differences between the measured values of the waveform parameters and the corresponding reference values of the channel "A" pressure waveform parameters. If the absolute differences between the measured and reference values are less than predetermined maximum variation levels microprocessor 80 retrieves a channel "A" interval time from interval timer 88 and stores this channel "A" interval time along with other related information in therapy register 90, as described below. Microprocessor 80 then generates a channel "A" interval timer reset signal which is communicated to interval timer 88. Similarly, microprocessor 80 operates as described above to analyzes the channel "B" and channel "C" pressure signals in order to measure predetermined waveform parameters for which reference values have been retrieved from waveform parameter register 86, to compute the differences between the measured and reference values of the channel "B" waveform parameters and channel "C" waveform parameters, to retrieve and reset the channel "B" and channel "C" interval times from interval timer 88, and to store the channel "B" and channel "C" interval times along with other related information in therapy register 90. Alternatively, microprocessor 80 will, when instructed by the operator via control panel 42, operate to compute the differences between the measured values of the channel "A", "B", and "C" pressure waveform parameters and the corresponding reference values of the channel "A", "B", and "C" pressure waveform parameters. If and only if the absolute differences between the measured and reference values are all less than predetermined maximum variation levels microprocessor 80 retrieves a channel "A" interval time from interval timer 88 and stores this channel "A" interval time along with other related information in therapy register 90. Microprocessor 80 then generates a channel "A" interval timer reset signal which is communicated to interval timer 88.

When operating in this manner, the channel "A" interval time is representative of the interval between two occurrences when the measured values of channel "A", "B" and "C" pressure waveform parameters are within predetermined limits of reference values for their respective pressure waveform parameters.

Interval timer 88 shown in FIG. 2 maintains independent timers for channel "A", channel "B", and channel "C." In the preferred embodiment the timers are implemented as counters that are incremented every 100 ms. The rate at which the counters are incremented determines the minimum interval time that can be resolved. Microprocessor 80 communicates with interval timer 88 to read the current values of the counters and also to reset the counters. Interval timer 88 includes a battery as an alternate power source and continues to increment the counters during any interruption in the supply of electrical power from power supply 92 required for the normal operation of limb compression therapy monitor 2.

Real time clock 94 shown in FIG. 2 maintains the current time and date, and includes a battery as an alternate power source such that clock operation continues during any interruption in the supply of electrical power from power supply 96 required for the normal operation of limb compression therapy monitor 2. Microprocessor 80 communicates with real time clock 94 for both reading and setting the current time and date.

Therapy register 90 shown in FIG. 2, records "events" related to the monitoring of compression therapy delivered to a patient by a pneumatic compression system. "Events" are defined in the preferred embodiment to include: (a) actions by the operator to select pressure waveform parameters and corresponding reference values for the pressure waveform parameters for channels "A", "B", and "C"; (b) alarm events resulting from microprocessor 80 generating alarm signals as described below; and (c) interval time events resulting from microprocessor 80 determining the interval between the application of pressure waveforms having predetermined desired parameters.

Microprocessor 80 communicates with therapy register 90 to record events. Microprocessor 80 records an event by communicating to therapy register 90: the time of the event as read from real time clock 94, and a value identifying which one of a specified set of events occurred and which channel of limb compression therapy monitor 2 the event is associated with as determined by microprocessor 80. Also, if the event relates to channel "A" of limb compression therapy monitor 2, therapy register 90 records the values at the time of the event of the following parameters: the reference value of the channel "A" pressure waveform parameter, the measured value of the channel "A" pressure waveform parameter, and the channel "A" interval time. Alternatively, if the event relates to channel "B" of limb compression therapy monitor 2, therapy register 90 records the values at the time of the event of the following parameters: the reference value of the channel "B" pressure waveform parameter, the measured value of the channel "B" pressure waveform parameter, and the channel "B" interval time. Alternatively, if the event relates to channel "C" of limb compression therapy monitor 2, therapy register 90 records the values at the time of the event of the following parameters: the reference value of the channel "C" pressure waveform parameter, the measured value of the channel "C" pressure waveform parameter, and the channel "C" interval time. Therapy register 90 retains information indefinitely in the absence or interruption of electrical power from power supply 92 required for the normal operation of limb compression therapy monitor 2.

Microprocessor 80 generates alarm signals to alert the operator of limb compression therapy monitor 2, and patient whose compression therapy is being monitored by limb compression therapy monitor 2, off an excessive interval has elapsed between the application of pressure waveforms having desired values of waveform parameters. This allows the operator or the patient to take corrective action, for example by adjusting the application or positioning of leg sleeve 6 on the limb or by changing the operation of sequential pneumatic compression device 4 in an effort to reduce future measured intervals to values below the predetermined maximum interval. Microprocessor 80 periodically retrieves from interval timer 88 the current values of the channel "A", channel "B", and channel "C" interval times. If any interval time value exceeds a predetermined maximum of 5 minutes microprocessor 80 will generate an alarm signal associated with the channel "A", channel "B", or channel "C" interval time. Microprocessor 80 will, in response to generated alarm signals, alert the operator by text and graphic messages shown on display 38 and by audio tones. Electrical signals having different frequencies to specify different alarm signals and conditions are produced by microprocessor 80 and converted to audible sound by loud speaker 96 shown in FIG. 2.

Microprocessor 80, when directed by an operator of limb compression therapy monitor 2 through manipulation of control panel 42, subsequently displays, prints or transfers to an external computer the values associated with events stored in therapy register 90. For example, microprocessor 80 in response to an operator of limb compression therapy monitor 2 manipulating control panel 42 will retrieve from therapy register 90 all events associated with determining interval times and the corresponding information associated with those events. Microprocessor 80 will then tabulate the retrieved information and will present on display 38 a display detailing the history of interval times between the application of pressure waveforms having desired reference parameters for channels "A", "B", and "C" of limb compression therapy monitor 2. In the preferred embodiment, such information includes: the longest interval between two pressure waveforms with measured values of their pressure waveform parameters within a predetermined limit of reference values for their pressure waveform parameters; the average interval between two pressure waveforms with measured values of their pressure waveform parameters within a predetermined limit of reference values for their pressure waveform parameters; and the cumulative total of the interval times between pressure waveforms with measured values of their pressure waveform parameters within a predetermined limit of reference values for their pressure waveform parameters. Also for example, microprocessor 80 in response to control panel 40 will calculate and present on display 38 the elapsed time between a first event recorded in therapy register 90 and a second event recorded in therapy register 90 by computing the difference between the time at which the first event occurred and the time when the second event occurred.

Microprocessor 80 continues to monitor the compression therapy delivered by sequential pneumatic compression device 4 until an operator through manipulation of control panel 42 directs microprocessor 80 to suspend monitoring.

Power supply 92 provides regulated DC power for the normal operation of all electronic and electrical components within limb compression therapy monitor 2.

Alternatively, other embodiments of limb compression therapy monitor 2 may be implemented. For example, in another embodiment limb compression therapy monitor 2 may be incorporated within a sequential pneumatic compression device such as sequential pneumatic compression device 4 described above, thereby sharing a common display and control panel. In this embodiment, limb compression therapy monitor 2 is adapted to produce a feedback signal indicative of the interval times monitored and recorded by limb compression therapy monitor 2. The sequential pneumatic compression device uses this feedback signal to adapt the pressures produced in sleeves connected to the sequential pneumatic compression device, thereby adapting the compression therapy delivered to the patient to reduce measured interval times to values below a predetermined maximum interval time. In another embodiment, limb compression therapy monitor 2 may be adapted to monitor the compression therapy delivered to two or more inflatable sleeves with one, two, or more inflatable chambers per sleeve.

II. Software

Figure 3:
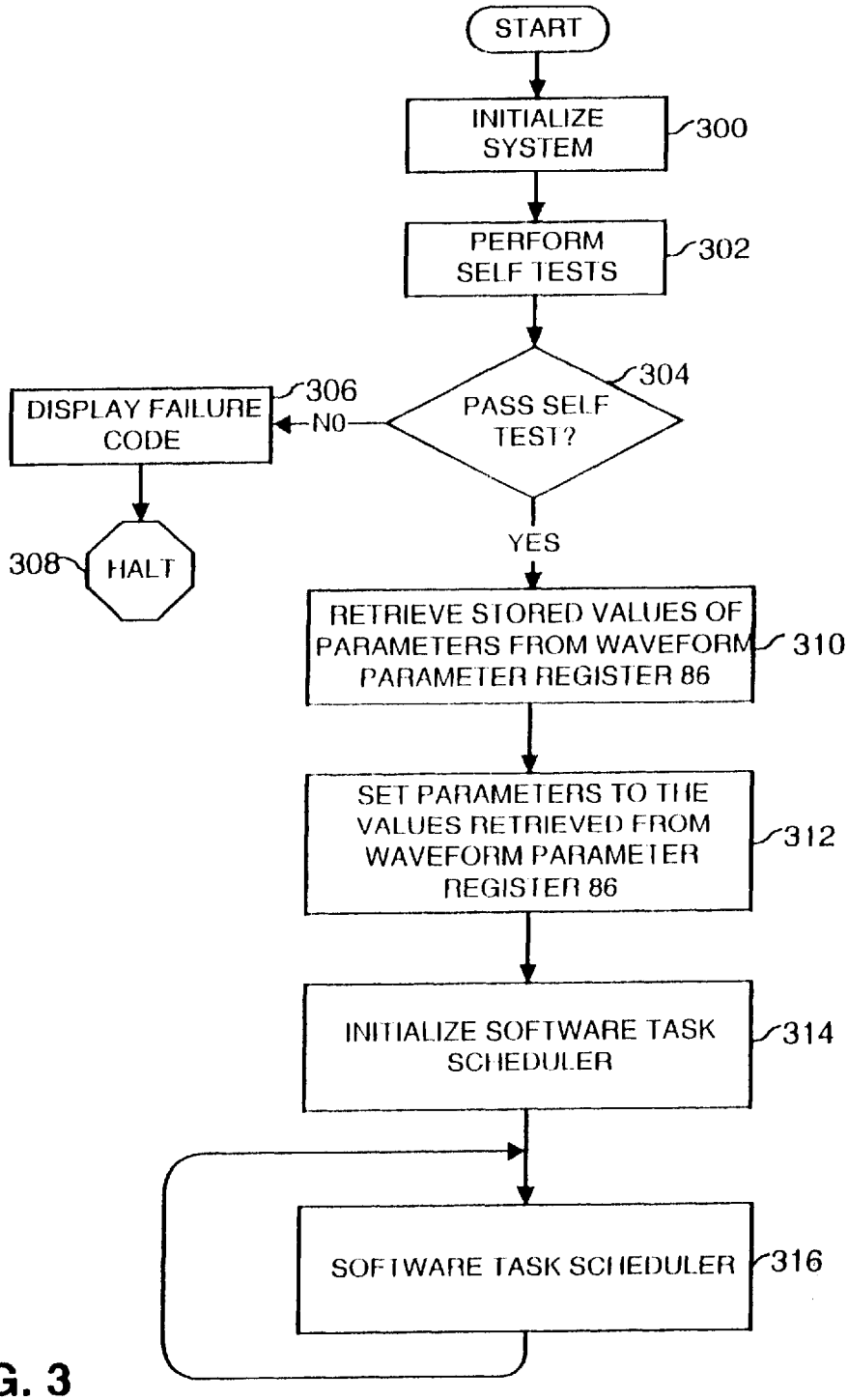
FIGS. 3, 4, and 5 are software flow charts depicting sequences of operations carried out in the preferred embodiment.
Figure 4:
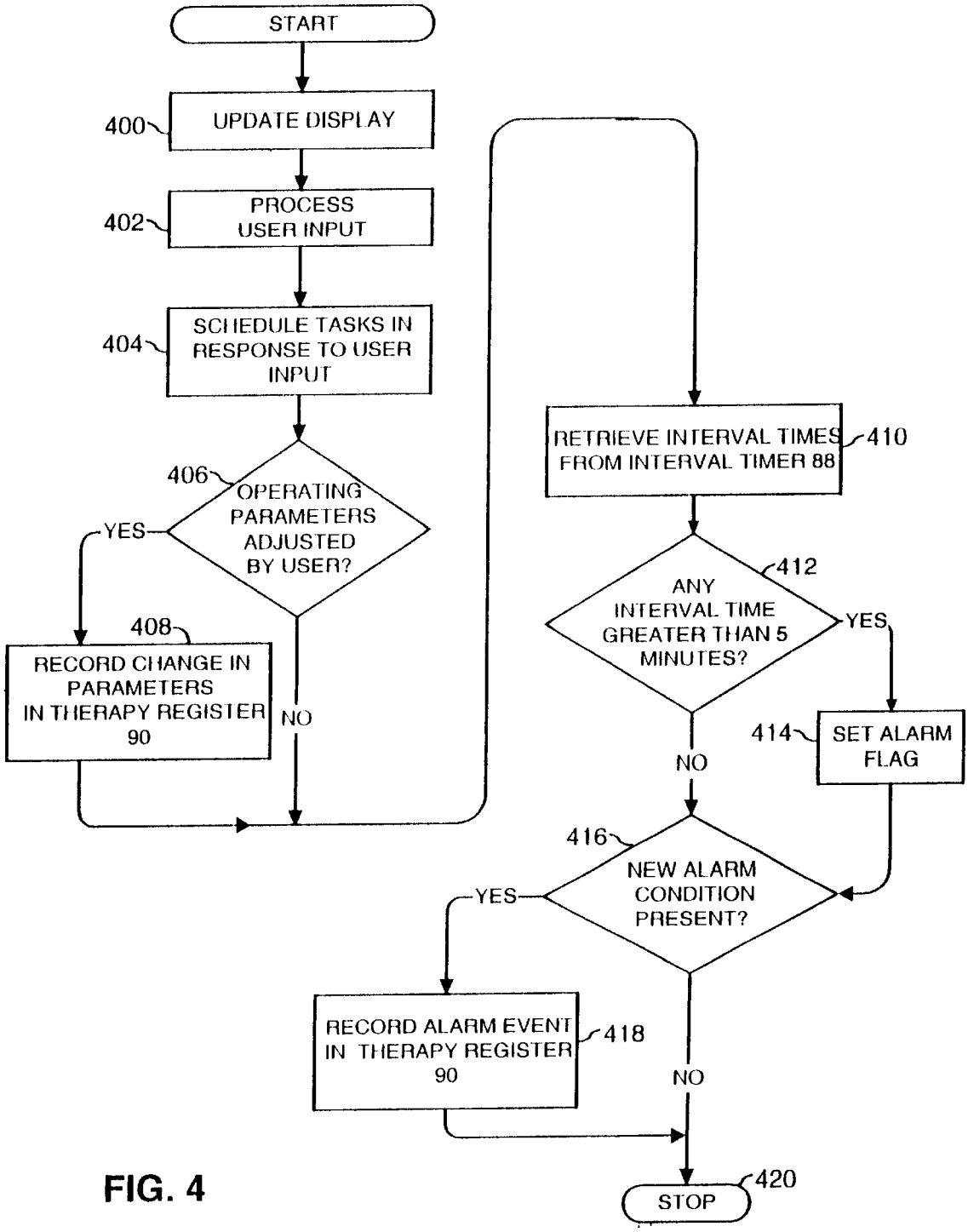
Figure 5:
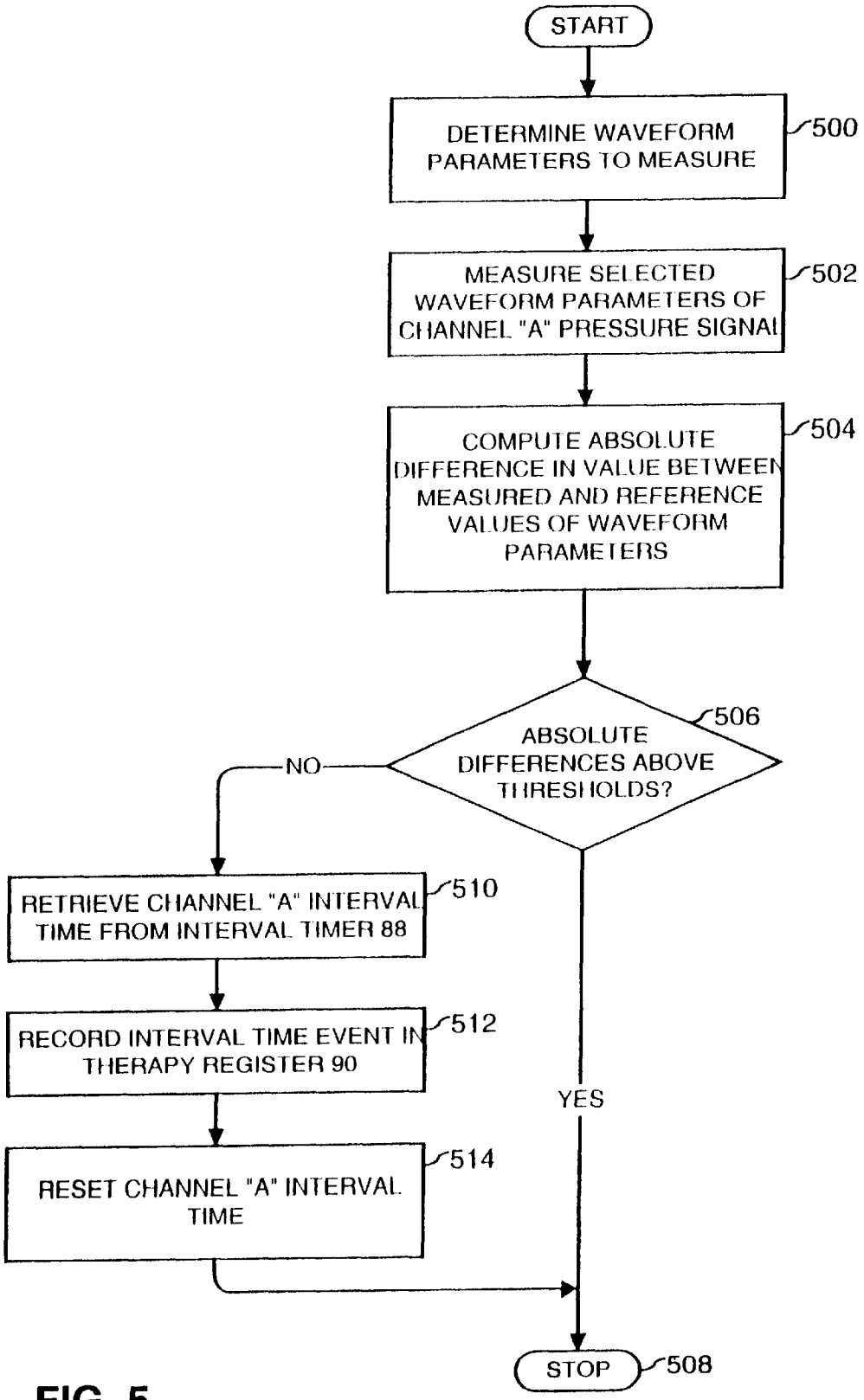

FIGS. 3, 4, and 5, are software flow charts depicting sequences of operations which microprocessor 80 is programmed to carry out in the preferred embodiment of the invention. In order to simplify the discussion of the software, a detailed description of each software subroutine and of the control signals which the software produces to actuate the hardware described above is not provided. The flow charts shown and described below have been selected to enable those skilled in the art to appreciate the invention. Functions or steps carried out by the software are described below and related to the flow charts via parenthetical reference numerals in the text.

FIG. 3 shows the initialization operations carried out by the main program. FIG. 4 shows a software task associated with updating display 38, processing input from an operator, monitoring interval times, and updating therapy register 90. FIG. 5 shows a software task associated with the continuous monitoring of the pressure waveform parameters.

FIG. 3 shows the initialization operations carried out by the system software. The program commences (300) when power is supplied to microprocessor 80 by initializing microprocessor 80 for operation with the memory system and circuitry and hardware of the preferred embodiment. Control is then passed to a self-test subroutine (302). The self-test subroutine displays a "SELF TEST" message on display 38 and performs a series of diagnostic tests to ensure proper operation of microprocessor 80 and its associated hardware. Should any diagnostic test fail (304), a failure code is displayed on display 38 (306) and further operation of the system is halted (308); if no errors are detected, control is returned to the main program.

As can be seen in FIG. 3, after the "self-test" has been completed successfully, control is next passed to a subroutine (310) which retrieves from waveform parameter register 86 the reference values of predetermined waveform parameters. The specific reference values retrieved from waveform parameter register 86 by subroutine (310) are determined by the type of compression therapy to be monitored as selected by therapy selector 40. Upon completion, this subroutine returns control to the main program. Control is next passed to a subroutine (312) which sets the current reference values of the pressure waveform parameters to the reference values of the pressure waveform parameters retrieved from waveform parameter register 86. Next, a software task scheduler is initialized (314). The software task scheduler executes at predetermined intervals software subroutines which control the operation of limb compression therapy monitor 2. Software tasks may be scheduled to execute at regularly occurring intervals. For example the subroutine shown in FIG. 4 and described below executes every 50 milliseconds. Other software tasks execute only once each time they are scheduled. The software task scheduler (316) continues to execute scheduled subroutines until one of the following occurrences: (a) power is no longer supplied to microprocessor 86; or (b) the operation of microprocessor 86 has been halted by software in response to the software detecting an error condition.

FIG. 4 shows a flowchart of the software task associated with updating display 38, processing input from an operator and testing for interval time alarm conditions. This task is executed at regular predetermined intervals of 50 milliseconds. Control is first passed to a subroutine that updates the menus of commands and values of displayed parameters shown on display 38 (400). The menus of commands and parameters shown on display 38 are appropriate to the current operating state of limb compression therapy monitor 2 as determined and set by other software subroutines.

Control is next passed to a subroutine (402) which processes the input from control panel 42. In response to operator input by means of control panel 42 other software tasks may be scheduled and initiated (404). For example, if the operator has selected a menu command to display the history of interval times between the application of pressure waveforms having desired reference parameters for channel 'A', software tasks will be scheduled to retrieve channel "A" interval times recorded in therapy register 90 and compute and display the history. The history of interval times may include the longest interval, and the cumulative total of all interval times between the application of pressure waveforms.

Control then passes to a subroutine (406) which determines if the operating parameters (reference values of the pressure waveform parameter selections, initiation or suspension of the monitoring of pressure waveform parameters) of limb compression therapy monitor 2 which affect the monitoring of therapy delivered to a patient have been adjusted by an operator of limb compression therapy monitor 2. Current values of operating parameters are compared to previous values of operating parameters. If the current value of any one or more parameters differs from its previously set value control is passed to a subroutine (408) for recording events in therapy register 90. This subroutine (408) records an event by storing the following in therapy register 90: the time of the event as read from real time clock 94; and a value identifying which one or more of a specified set of events occurred and which channel of limb compression therapy monitor 2 the event is associated with as determined by subroutine (406).

As shown in FIG. 5 control is next passed to a subroutine (410) which retrieves from interval timer 88 the values of the channel "A" interval time, the channel "B" interval time, and the channel "C" interval time. If any of the interval times is above a predetermined threshold of 5 minutes (412) an alarm flag is set (414) to indicate that one of the interval times has exceeded the threshold.

Control is next passed to a subroutine (416) which compares the current alarm conditions to previous alarm conditions. If any one or more alarm conditions exist which did not previously exist, control is passed to a subroutine (418) for recording the alarm event in therapy register 90. Subroutine (418) records an alarm event by storing in therapy register 90 the time of the event as read from real time clock 94; a value identifying which one or more of a specified set of alarm events occurred as determined by subroutine (418). The software task shown in FIG. 4 then terminates (420).

FIG. 5 depicts the software task associated with the determination of the time intervals between the application of pressure waveforms having predetermined desired parameters. For simplicity only the software task associated with channel "A" has been shown in FIG. 5; a similar software task to the one shown in FIG. 5 is scheduled to execute periodically for channel "B", and another similar software task to the one shown in FIG. 5 is scheduled to execute periodically for channel "C". As shown in FIG. 5 a subroutine (500) that determines which specific waveform parameters are to be measured is executed. This subroutine (500) uses the reference values of the channel "A" pressure waveform parameters to determine which waveform parameters of the channel "A" pressure signal are to be measured. For example, if reference values for maximum pressure in a cycle period and the rate of rise of pressure during a portion of the reference waveform cycle time period are present for channel "A", the subroutine (500) will select these as the waveform parameters to be measured.

Control is next passed to a subroutine (502) which analyzes the channel "A" pressure signal and measures the values of the waveform parameters as selected by the previously executed subroutine (500). Control then passes to a subroutine (504) that calculates the absolute difference between the measured values of the pressure waveform parameters and the corresponding reference values for these parameters. If the absolute differences between the measured and reference values are above predetermined thresholds (506) the software task shown in FIG. 5 terminates (508). If the absolute differences between the measured and reference values are not above predetermined thresholds (506) the control is passed to subroutine (510).

This subroutine (510) retrieves the channel "A" interval time from interval timer 88. Next control is passed to a subroutine (512) which records in therapy register 90 an interval time event. The subroutine (512) stores in therapy register 90 the time of the event as read from real time clock 94 and a value identifying that an interval time event associated with channel "A" has occurred. The subroutine (512) also stores the values of the following parameters at the time of the event: channel "A" interval time, channel "A" waveform selection signal, channel "A" reference pressure waveform and channel "A" sleeve pressure signal.

As shown in FIG. 5 control next passes to a subroutine (514) which resets the interval timer associated with channel "A". The software task shown in FIG. 5 then terminates (508).

We claim:

1. Apparatus for monitoring the delivery of pneumatic pressure waveforms through an inflatable sleeve positioned on a patients's limb in order to augment the flow of venous blood and thereby reduce the incidence of deep venous thrombosis and embolism in the limb, comprising:

a sleeve adapted for positioning onto a patients's limb and to be cyclically pressurized to augment venous blood flow in the limb;

pressure transducing means connectable to communicate pneumatically with the sleeve for producing for each pressurization cycle a sleeve pressure signal representing all of the changes in amplitude of the pressure in the sleeve over time and throughout the entire pressurization cycle so that the sleeve pressure signal defines a pressure waveform that is produced in the sleeve throughout each pressurization cycle;

waveform parameter measurement means responsive to the sleeve pressure signal for measuring a parameter of the pressure waveforms that are produced during successive pressurization cycles and for producing a waveform parameter signal that is indicative of the measured waveform parameters, each one cycle of the succession of pressurization cycles producing a discrete pressure waveform in the sleeve; and interval determination means responsive to the waveform parameter signal for producing and recording an interval signal indicative of a time interval between at least two successive pressurization cycles of the sleeve during which the measured parameters that correspond to successive pressurization cycles fall within a predetermined range.

2. The apparatus of claim 1 wherein the measured pressure waveform parameter is the difference between a measured pressure level in the sleeve at a time during a pressurization cycle and a predetermined reference pressure level.

3. The apparatus of claim 1 wherein the measured pressure waveform parameter is a maximum level of pressure produced in the sleeve during a pressurization cycle.

4. The apparatus of claim 1 wherein the measured pressure waveform parameter is a rate at which pressure in the sleeve increases during a pressurization cycle.

5. The apparatus of claim 1 wherein the measured pressure waveform parameter is a time period during which the pressure in the sleeve is above a predetermined pressure threshold level.

6. The apparatus of claim 1 wherein the interval determination means further produces an indication of a time interval during which the measured parameters that correspond to successive pressurization cycles fall outside of a predetermined range.

7. The apparatus as described in claim 1 wherein the interval determination means further produces a plurality of interval signals as defined in claim 1 and corresponding to a plurality of sleeve pressurization cycles.

8. The apparatus of claim 7 and including computing means responsive to the plurality of interval signals for producing an indication of the longest time interval corresponding to the plurality of interval signals.

9. The apparatus of claim 7 and including computing means responsive to the plurality of interval signals for producing an indication of the average time interval corresponding to the plurality of interval signals.

10. The apparatus of claim 7 and including computing means responsive to the plurality of interval signals for producing an indication of the cumulative total time interval corresponding to the sum of time intervals indicated the plurality of interval signals.

11. The apparatus of claim 1 and including alarm means responsive to the interval signal for producing an indication perceptible to a human when the time interval exceeds a predetermined maximum time interval.

12. The apparatus of claim 1 further comprising control means for enabling an operator to select for measurement by the waveform parameter measurement means one from a plurality of predefined waveform parameters.

13. The apparatus of claim 1 and including pressurizing means for pressurizing the sleeve, wherein the pressure transducing means is connectable through tubing means to communicate pneumatically with the sleeve and wherein the sleeve is connected between the pressure transducing means and the pressurizing means.

14. The apparatus of claim 1 and including pressurizing means responsive to a feedback signal for pressurizing the sleeve and further including feedback means responsive to the interval signal for producing the feedback signal.

* * * * *